US005934085A

United States Patent [19]

Suzuki et al.

[11] Patent Number: 5,934,085

[45] Date of Patent: Aug. 10, 1999

[54] THERMAL INSULATOR CABINET AND METHOD FOR PRODUCING THE SAME

[75] Inventors: Masaaki Suzuki; Takashi Hashida, both of Osaka; Takayoshi Ueno, Katano, all of Japan

[73] Assignee: Matsushita Electric Industrial Co., Ltd., Osaka-Fu, Japan

[21] Appl. No.: 09/025,098

[22] Filed: Feb. 17, 1998

[30] Foreign Application Priority Data

Feb. 24, 1997 [JP] Japan ..... 9-039215
Mar. 11, 1997 [JP] Japan ..... 9-055972

[51] Int. Cl.[6] ..... F25D 17/02; F25D 19/00; A47B 96/04; B65D 1/36

[52] U.S. Cl. ..... 62/98; 62/298; 62/DIG. 13; 312/401; 220/592.1; 220/592.27; 220/DIG. 18

[58] Field of Search ..... 62/3.6, 60, 77, 62/78, 98–99, 100–238.1, 238.6, 267, 298, 383, 405, 440, 441, DIG. 13; 312/400, 401–406; 220/592.02, 592.1, 592.27, 902, 918, DIG. 9, DIG. 18

[56] References Cited

U.S. PATENT DOCUMENTS

| | | | |
|---|---|---|---|
| 1,518,668 | 12/1924 | Mitchell | 220/592.02 |
| 1,898,977 | 2/1933 | Comstock | 312/401 |
| 3,114,469 | 12/1963 | Francis et al. | 220/9 |
| 3,993,811 | 11/1976 | Walles | 428/35 |
| 4,745,015 | 5/1988 | Cheng et al. | 428/35 |
| 4,938,667 | 7/1990 | Della Porta | 417/48 |
| 5,082,335 | 1/1992 | Cur et al. | 312/401 |
| 5,271,240 | 12/1993 | Detrick et al. | 62/268 |
| 5,473,901 | 12/1995 | Roseen | 62/DIG. 13 |
| 5,512,345 | 4/1996 | Tsutsumi et al. | 428/69 |
| 5,625,742 | 4/1997 | Boffito et al. | 392/345 |

FOREIGN PATENT DOCUMENTS

| | | |
|---|---|---|
| 0 638 607 A1 | 2/1995 | European Pat. Off. . |
| 07148752 | 6/1995 | Japan . |
| 7-89004 | 9/1995 | Japan . |
| 2543041 | 10/1996 | Japan . |
| WO 96/21564 | 7/1996 | WIPO . |

*Primary Examiner*—William Doerrler
*Attorney, Agent, or Firm*—Panitch Schwarze Jacobs & Nadel, P.C.

[57] ABSTRACT

The present invention provides a thermal insulator cabinet having high thermal insulating ability and long-term reliability as well as excellent energy-saving and maintenance properties. The thermal insulator cabinet includes a gas-tight container that is filled with a charging gas and a continuous spacing core and a gas-storage container that communicates with the gas-tight container and is filled with an absorbent for absorbing at least the charging gas, wherein the gas-storage container absorbs the charging gas to make inside of the gas-tight container in a state of reduced pressure.

14 Claims, 7 Drawing Sheets

THERMAL INSULATOR CABINET AND METHOD FOR PRODUCING THE SAME

BACKGROUND OF THE INVENTION

The present invention relates to a thermal insulator cabinet applicable for refrigerators, freezers, insulating containers, and storage containers as well as to a method of manufacturing the same.

Development of high-performance apparatus and equipment has been required for the energy-saving purpose. Improvement in performance of thermal insulators by the vacuum insulating technique is essential to improve the performance of thermal insulator cabinets.

Vacuum insulating panels are a typical example of vacuum insulators used for refrigerators. The vacuum insulating panel is manufactured by covering a continuous-spacing core member, such as open-cell hard urethane foam, with a gas-barrier metal-plastic laminate film and evacuating and packing the covered core (for example, Japanese Laid-Open Patent Publication Hei 7-293785). The vacuum insulating panel is further processed to have a double structure when being applied to the thermal insulator cabinet of, for example, refrigerators. The process sticks the vacuum insulating panels to a container of the cabinet and injects an expandable urethane resin for foam molding.

Another technique applied to manufacture the vacuum insulator cabinets is evacuation (for example, Japanese Laid-Open Patent Publication Hei 6-174186 and 7-148752). The thermal insulator cabinet is filled with the material having a closed-cell structure or a continuous-spacing structure and evacuated with a vacuum pump. In another example, a vacuum indicator is used to monitor a variation in thermal insulating performance with time and carry out evacuation according to the requirements (Japanese Laid-Open Patent Publication Hei 7-148752).

The foam molding process may be applied to control the gas constituents in the cells, which affect the thermal insulating ability of expanded insulators, and manufacture the vacuum insulators (for example, Japanese Laid-Open Patent Publication Hei 7-53757 and 7-53769). In these proposed methods, a carbon dioxide-fixing agent is added to the resin material. The carbon dioxide-fixing agent fixes carbon dioxide existing in the cells in the carbon dioxide-blown resin insulators, so as to reduce the pressure in the cells or evacuate the cells and improve the thermal insulating ability.

A typical procedure of manufacturing the vacuum insulating panel discussed above prepares a block of open-cell hard urethane foam, cuts the block into a core of an arbitrary size, and packs the core in vacuo. The vacuum insulating panels should be manufactured separately before being combined with standard expanded insulators. This also requires the process of sticking the vacuum insulating panels to the container of the thermal insulator cabinet. It is accordingly not preferable from the viewpoints of productivity, workability, and cost. Since the vacuum insulating panels are combined with expanded insulators, there is inevitably a part of the surface of the thermal insulator cabinet not covered with the vacuum insulating panel. This causes deterioration of the vacuum insulating ability. The vacuum insulating panels do not have any means for recovering the worsened degree of vacuum of the vacuum insulating panels with time. This lowers the thermal insulating ability and causes the poor long-term reliability.

Unlike the manufacturing method with the vacuum insulator panels, the method of manufacturing a thermal insulator cabinet by the evacuation technique does not require the separate manufacturing process or the sticking process, but enables the whole cabinet to be set in the vacuum insulating state. This method, however, requires a vacuum pump for evacuation and a long-time evacuation is essential for the sufficient degree of vacuum. This results in the poor productivity. In order to maintain the thermal insulating ability over time, the evacuation with a vacuum pump should be continued or otherwise carried out repeatedly based on the monitored degree of vacuum. This causes the poor workability and the poor long-term reliability.

The method of foam molding the vacuum insulators has excellent productivity and ensures the long-term reliability by fixation of carbon dioxide. Addition of the carbon dioxide-fixing agent to the resin material may cause fixation of carbon dioxide to start before the resin is completely blown with carbon dioxide. This may result in contraction of the foamed resin that has not yet been completely cured. An increase in amount of carbon dioxide to prevent this problem increases the required amount of the carbon dioxide-fixing agent and lowers the productivity.

SUMMARY OF THE INVENTION

The object of the present invention is thus to solve the above problems and provide a thermal insulator cabinet having high thermal insulating ability and long-term reliability as well as excellent productivity and cost performance.

The present invention provides a thermal insulator cabinet comprising a gas-tight container that is filled with a charging gas and a continuous spacing core and a gas-storage container that communicates with the gas-tight container and is filled with an absorbent for absorbing at least the charging gas, wherein the gas-storage container absorbs the charging gas to make inside of the gas-tight container in a state of reduced pressure.

In accordance with one preferable mode of the present invention, the thermal insulator cabinet further comprises a thermal system for carrying out a heat exchange with the gas-tight container.

The thermal insulator cabinet of the present invention preferably has at least either one of the following structures. In one preferable structure, the absorbent is a physical absorbent and the gas-storage container is constructed to carry out a heat exchange with a heat-absorbing portion of the thermal system. In another preferable structure, the absorbent is a chemical absorbent and the gas-storage container is constructed to carry out a heat exchange with a heat-discharging portion of the thermal system.

The thermal insulator charged in the gas-tight container of the thermal insulator cabinet preferably has a continuous-spacing structure. It is preferable that a mean gap distance of the continuous-spacing core in the charged state is not greater than a mean free path of the charging gas at 20° C. and 1/100 atmospheric pressure.

Favorable examples of the thermal system include a cooling system with a compressor and a cooling system by a thermoelectric transducer.

The present invention is also directed to a method of manufacturing a thermal insulator cabinet, the method comprising the steps of:

charging a continuous-spacing core into a gas-tight container with a charging gas; and introducing the charging gas into a gas-storage container, which is arranged to communicate with the gas-tight container, and causing the charging gas to be absorbed by an absorbent in the gas-storage container, thereby making the gas-tight container in a state of reduced pressure.

It is preferable that the gas-tight container communicates with the gas-storage container by an on-off valve or a gas-permeable material.

In accordance with one preferable mode of the method of the present invention, the step of charging the continuous-spacing core comprises the steps of:

injecting an urethane material that comprises at least a polyol, water, and an isocyanate into the gas-tight container; and charging a water-blown open-cell urethane resin into the gas-tight container with carbon dioxide produced through a reaction of the urethane material, and the gas storage step comprising the step of:

causing carbon dioxide to be absorbed by the absorbent in the gas-storage container.

In accordance with another preferable mode of the present invention, the step of charging the continuous-spacing core comprises the step of enclosing a powdery material into the gas-tight container with the charging gas.

In accordance with still another preferable mode of the present invention, the step of charging the continuous-spacing core comprises the steps of:

injecting an expandable particle material, which includes a blowing agent and is either non-processed or preliminary expanded, into the gas-tight container; and heat treating the expandable particle material with steam to an expanded particle substance and charging the continuous-spacing core composed of the expanded particle substance into the gas-tight container, and the gas storage step comprising the step of:

causing the remaining steam to be absorbed by the absorbent in the gas-storage container.

It is preferable that the gas-storage container is filled with the absorbent of the charging gas and a mixture of absorbents of the constituents of the air, that is, nitrogen, oxygen, carbon dioxide, and steam.

The present invention provides a thermal insulator cabinet having excellent productivity and thermal insulating ability as well as long-term reliability of the thermal insulation.

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

Figure 1:
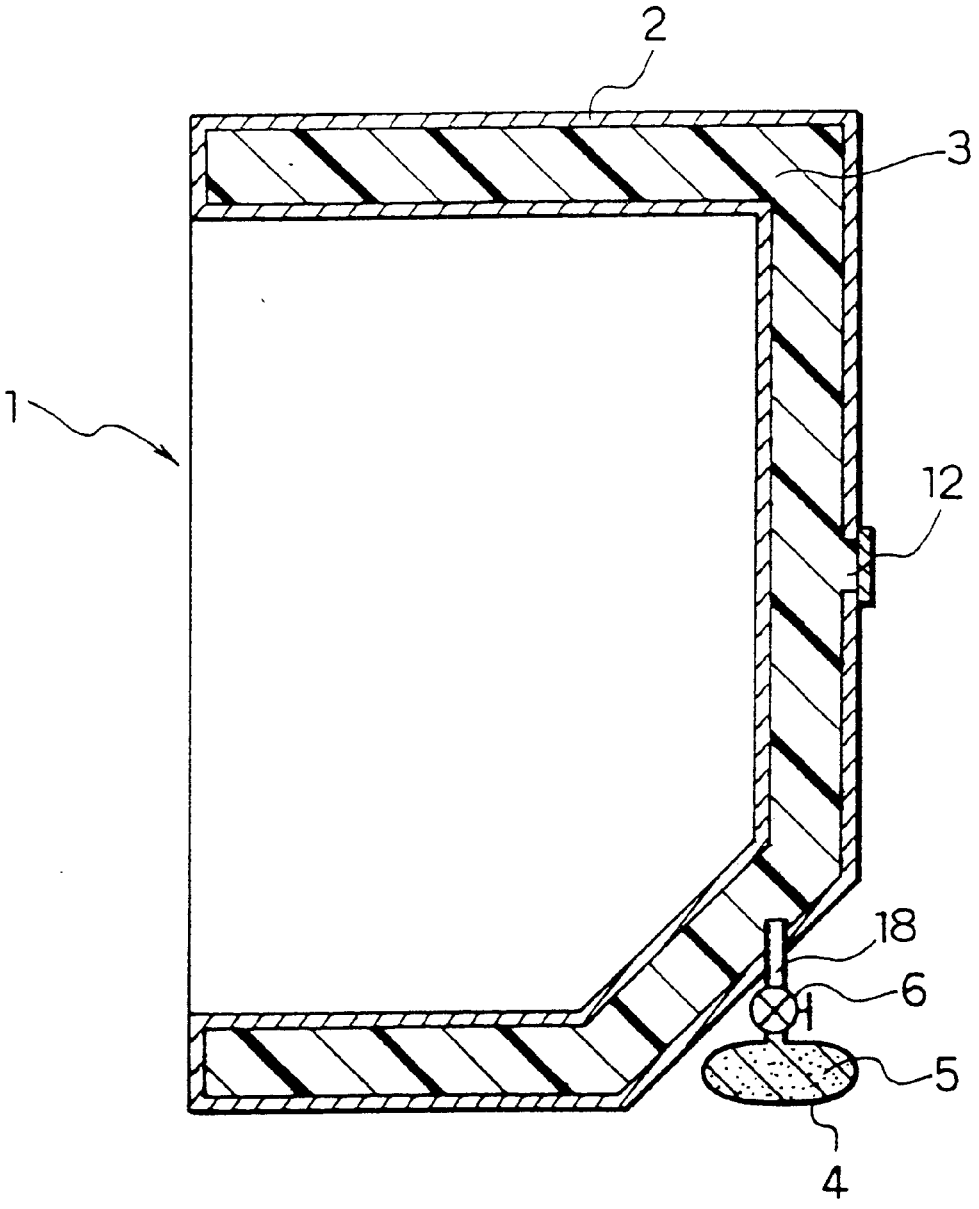
FIG. 1 is a cross sectional view illustrating a thermal insulator cabinet as a first embodiment according to the present invention.

In the thermal insulator cabinet of the present invention, the gas-tight container filled with the thermal insulator is in the state of reduced pressure, which realizes vacuum insulation. Since the gas-storage container filled with the gas-absorbing material communicates with the gas-tight container, the gases existing in the gas-tight container and the newly evolved gas components are kept in the gas-storage container. This makes the gas-tight container under reduced pressure. The structure of the present invention attains the vacuum insulation without evacuating the thermal insulator cabinet with a vacuum pump, and keeps the state of reduced pressure and thermal insulating ability over a long time period.

The present invention accordingly provides a thermal insulator cabinet having excellent thermal insulating ability, productivity, and workability.

In accordance with one preferable structure, a thermal system is arranged to carry out a heat exchange with the gas-storage container. The heat absorption into or the heat discharge from the thermal system enhances the absorbing capacity of the gas-absorbing material in the gas-storage container and efficiently keeps the gas-tight container in the state of reduced pressure. When a physical absorbent is used as the gas-absorbing material, it is preferable that the gas-storage container is arranged to carry out a heat exchange with a heat-absorbing portion of the thermal system. This cools down the gas-storage container and improves the adsorbing capacity of the physical absorbent. When a chemical absorbent is used as the gas-absorbing material, it is preferable that the gas-storage container is arranged to carry out a heat exchange with a heat-discharging portion of the thermal system. This heats the gas-storage container and accelerates the chemical reactions of the chemical absorbent, thereby improving the fixation performance of the gas. The thermal insulator cabinet may have either one of or both of these structures. In practice, either one of the structures is selected, and the physical or the chemical absorbent is combined with a plurality of other gas-absorbing materials.

The arrangement of the gas-storage container inside the thermal insulator cabinet, which is subjected to a heat exchange with the thermal system and kept in the controlled temperature, enhances the absorbing capacity of the gas-absorbing material in the gas-storage container and efficiently keeps the gas-tight container in the state of reduced pressure.

The thermal insulator of continuous-spacing structure charged in the gas-tight container of the thermal insulator cabinet depresses a pressure loss affecting the gas flow in the gas storage and thereby efficiently keeps the gas-tight container in the state of reduced pressure.

Available examples of the thermal system include a cooling system with a compressor based on the principle of compression, condensation, expansion, and evaporation, a cooling system with a thermoelectric transducer of Pell-outier effect based on the principle of heat absorption, and a heat insulating system based on the principle of heat discharge. The structure of the heat exchange between the thermal system and the gas-storage container can be designed arbitrarily according to the application of the thermal insulator cabinet.

The structure with the thermal system gives the thermal insulator cabinet the energy-saving and maintenance effects.

The method of manufacturing such a thermal insulator cabinet according to the present invention exerts the following three effects from the viewpoints of productivity and workability, in addition to the excellent thermal insulating ability of the thermal insulator cabinet discussed above.

The first effect is high productivity and workability, since charging the continuous-spacing core into the gas-tight container readily produces the vacuum insulator integrated with the container.

The second effect is excellent productivity and long-term durability of the vacuum insulating performance, since connection of the gas-tight container with the gas-storage container attains evacuation of the gas-tight container without a vacuum pump. This enables the resulting thermal insulator cabinet to be substantially maintenance-free and have excellent workability, The third effect is to provide the high-quality thermal insulators with high productivity, which is realized by the separate arrangement of the gas-tight container and the gas-storage container. After the continuous-spacing core is charged into the gas-tight container with the charging gas to complete the fundamental structure of the thermal insulator, the charging gas is flown from the gas-tight container to the gas-storage container for absorption via an on-off valve or a gas-permeable material. This efficiently realizes the state of reduced pressure without causing contraction of the thermal insulators.

In the thermal insulator cabinet of the present invention, the gas-storage container communicating with the gas-tight container is disposed outside the thermal insulator cabinet. This arrangement facilitates the process of causing at least the charging gas to be absorbed by the gas-storage container and making the gas-tight container in the state of reduced pressure, after the continuous-spacing core is charged into the gas-tight container with the charging gas according to the manufacturing method discussed above. The gas-storage container may, however, be disposed inside the thermal insulator cabinet. This arrangement also realizes the excellent thermal insulating performance. The latter arrangement attains the effects of the present invention, although the workability and the free volume of the thermal insulator cabinet are reduced to some extent.

The following describes preferred embodiments of the present invention with accompanying drawings.

First Embodiment

FIG. 1 illustrates a thermal insulator cabinet 1 as a first embodiment according to the present invention. The thermal insulator cabinet 1 includes a gas-tight container 2 processed to a box-like shape and filled with a continuous-spacing core 3 to construct a thermal insulator. A gas-storage container 4 filled with an absorbing material 5 and a pipe 18 for connecting the gas-storage container 4 with the gas-tight container 2 are disposed outside the thermal insulator cabinet 1. The pipe 18 is provided with an on-off valve 6.

A typical process of manufacturing the thermal insulator cabinet 1 first closes the on-off valve 6 and injects a material of the continuous-spacing core 3 from an inlet 12 formed in the gas-tight container 2. The inlet 12 is kept open to discharge the air out of the gas-tight container 2, while enabling the material to be sufficiently charged into the gas-tight container 2 with the charging gas and form the continuous-spacing core 3. The inlet 12 is then closed and sealed. After the completion of the continuous-spacing core 3, the on-off valve 6 is opened, in order to cause the charging gas to be absorbed by the absorbing material 5 in the gas-storage container 4. This makes the gas-tight container 2 in the state of reduced pressure and gives the high-performance thermal insulator cabinet. The on-off valve 6 separates the charging process, the forming process, and the gas storage process from one another.

When the continuous-spacing core 3 is, for example, water-blown open-cell urethane resin, an urethane material containing at least a polyol, water, and an isocyanate is injected into the gas-tight container 2. Carbon dioxide produced through the reaction of the isocyanate with water in the urethane material expands the urethane material to urethane foam, while charging the urethane foam into the gas-tight container 2. After the urethane foam is sufficiently heated and cured in this foaming process, the on-off valve 6 is opened. In this case, the gas-storage container 4 is filled with at least a carbon dioxide-fixing agent as the absorbing material 5. Carbon dioxide used as the charging gas is flown from the gas-tight container 2 to the gas-storage container 4 to be stored therein. This makes the gas-tight container 2 in the state of reduced pressure and completes the vacuum insulator cabinet. Addition of an antifoamer such as foam inhibitor, foam breaker and cell-interconnecting agent to the urethane material causes the urethane foam to have an open-cell structure, which enables quick storage of carbon dioxide in the cells into the gas-storage container 4.

In another example, when the continuous-spacing core 3 is a molded object of inorganic powder or organic power, it is required to densely enclose a powder material of the molded object in the gas-tight container 2 with the charging gas. In this case, the powder material as well as the charging gas is pressed through the inlet 12 into the gas-tight container 2. After the inlet 12 is sealed and the charging process is completed, the gas storage process is carried out to store the charging gas into the gas-storage container 4 and make the gas-tight container into the state of reduced pressure. This provides a vacuum insulator of excellent thermal insulating performance integrated with the container.

It is preferable that the gas-storage container 4 is filled with the excess absorbing material 5, which is greater than the amount of the charging gas in the gas-tight container 2. This ensures the sufficient thermal insulating performance not only at the time of manufacture but over a long time period. Addition of absorbing materials for the remaining air and newly evolved gas components to the absorbing material 5 of the charging gas further enhances the above effects.

In still another example, when the continuous-spacing core 3 is an expanded particle substance, an expandable particle material, which includes a blowing agent and is either non-processed or preliminary expanded, is charged into the gas-tight container 2. The expandable particle material is subjected to heat treatment with steam. The steam pressure and the pressure of the vaporized blowing agent cause the particles to sufficiently expand and fill the gas-tight container 2. Regulating the load of the expandable particle material or controlling the steam temperature causes the expanded particles to have a continuous-spacing structure. In this case, the gas-storage container 4 is filled with at least a water absorbent as the absorbing material 5. This enables the steam used as the charging gas of the gas-tight container 2 to be stored into the gas-storage container 4 and makes the gas-tight container 2 in the state of reduced pressure.

The cells in the expanded particles have a closed structure, which is filled with the blowing agent and steam. Steam readily diffuses and passes through the cell wall of the expanded particles to be absorbed by the gas-storage container 4. The cells of the expanded particles are accordingly free from the steam of low thermal insulating performance and only filled with the vaporized blowing agent of high thermal insulating performance. This gives the excellent thermal insulating ability to the resulting thermal insulator cabinet 1. Addition of an absorbing material for the blowing agent to the gas-storage container 4 makes the vaporized blowing agent out of the closed cells of the expanded particles to attain vacuum insulation.

As clearly understood from the above discussion, use of a vacuum pump for the purpose of evacuation facilitates the charging process of the continuous-spacing core and the subsequent gas storage process. After the continuous-spacing core is charged into the gas-tight container 2, the gas-tight container 2 is evacuated for a short time period with a vacuum pump. The remaining charging gas is then absorbed by the gas-storage container 4, in order to make the gas-tight container 2 in the state of reduced pressure. This shortens the time period required for the gas storage and reduces the required amount of the absorbing material 5 in the gas-storage container 4.

Second Embodiment

Figure 3:
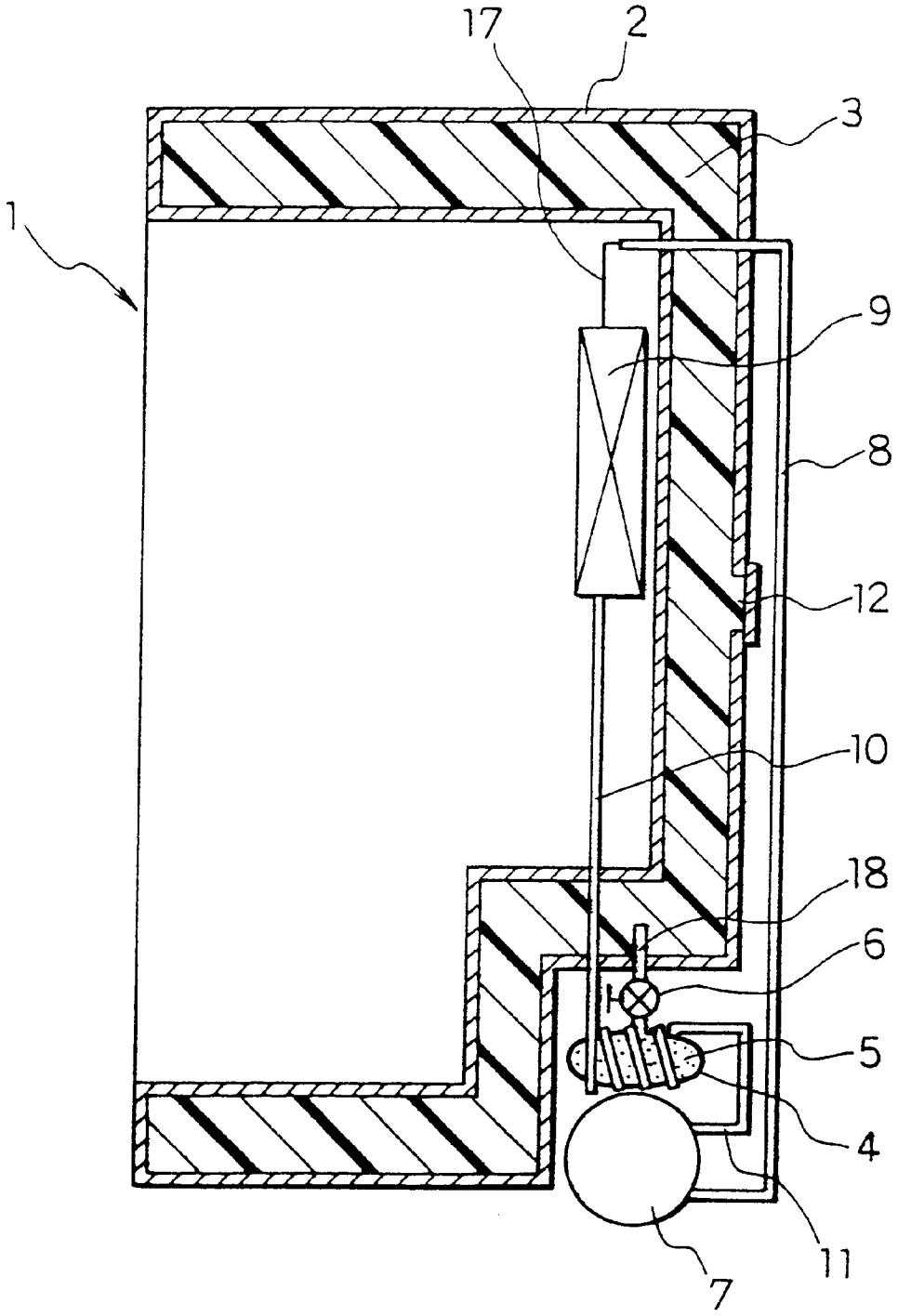
FIG. 3 is a cross sectional view illustrating another thermal insulator cabinet as a second embodiment according to the present invention.

FIG. 3 illustrates structure of another thermal insulator cabinet 1 as a second embodiment according to the present invention. In this embodiment, heat exchange is carried out between a heat-absorbing portion of a thermal system with a compressor and a gas-storage container.

The thermal insulator cabinet 1 includes a gas-tight container 2 filled with a thermal insulator 3, a gas-storage container 4 disposed outside the thermal insulator cabinet 1 and filled with a gas-absorbing material 5, and a thermal system with a compressor 7. The gas-storage container 4 is connected to the gas-tight container 2 via a pipe 18 with an on-off valve 6.

The thermal system includes the compressor 7 disposed outside the cabinet 1, an evaporator disposed inside the cabinet 1, a conduit 10 connecting the compressor 7 with the evaporator 9, an intake conduit 11 to the compressor 7, a condensation pipe 8, and a capillary pipe 17. A coolant of high-temperature, high-pressure gas discharged from the compressor 7 discharges heat in the condensation pipe 8 to the coolant of high-pressure, over-cooled liquid and goes through an expansion process, such as the capillary pipe 17 or an expansion valve, to the low-pressure two-phase coolant, which absorbs heat in the evaporator 9 and cools down the thermal insulator cabinet 1. The coolant then goes through the conduit 10 connecting with the evaporator 9 in the heat absorption state and exchanges heat with the gas-storage container 4 to the coolant of low-pressure heated gas, which is taken into the compressor 7.

A physical absorbent is mainly used as the gas-absorbing material 5. The gas-storage container 4 filled with the absorbent is continuously cooled through the heat exchange with the thermal system. This structure enables the charging gas used for charging the thermal insulator into the gas-tight container 2, the air, and the organic-component gases newly evolved to be efficiently adsorbed by the absorbent and stored into the gas-storage container 4. This keeps the gas-tight container 2 in the state of reduced pressure over a long time period.

Third Embodiment

Figure 4:
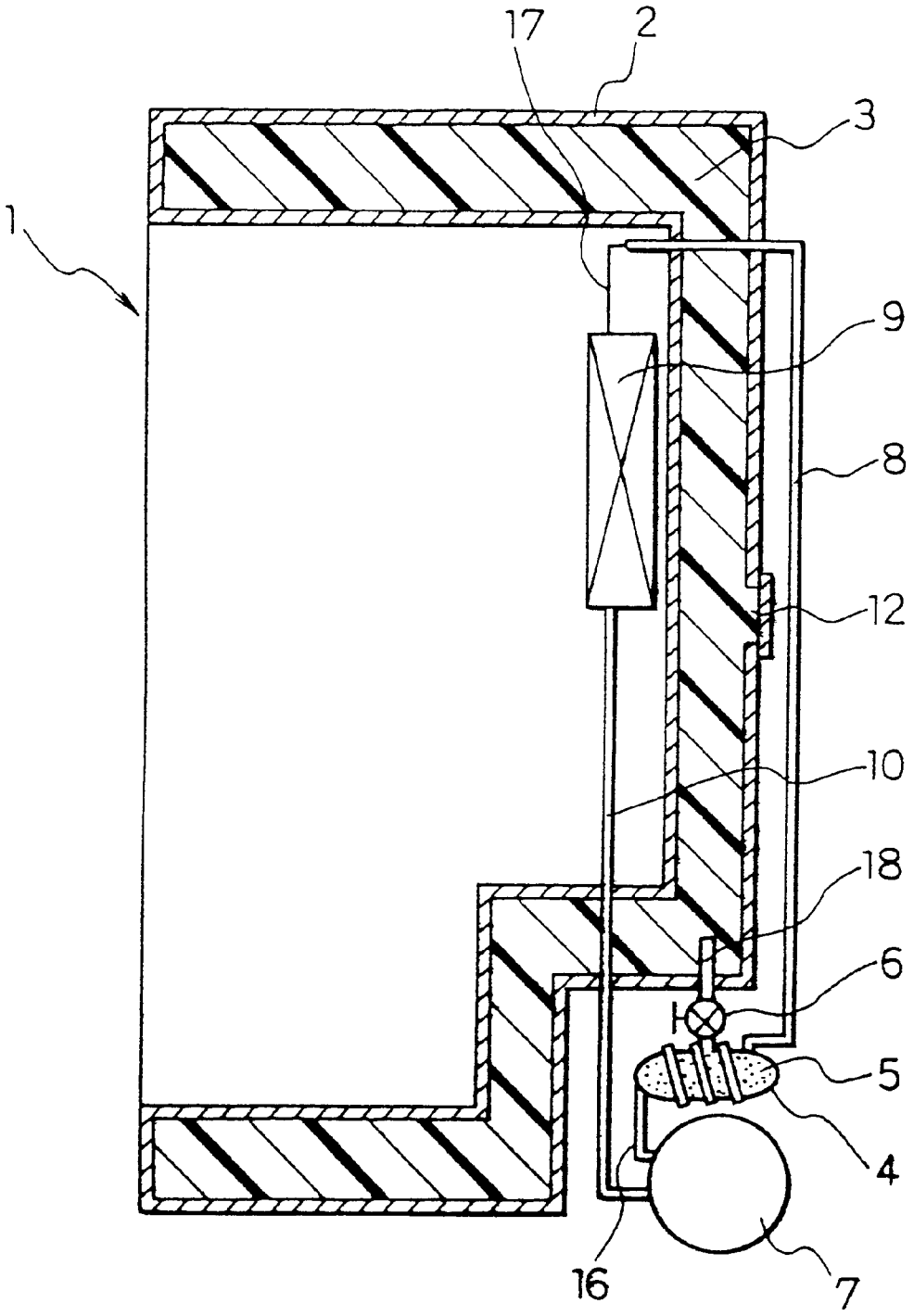
FIG. 4 is a cross sectional view illustrating still another thermal insulator cabinet as a third embodiment according to the present invention.

FIG. 4 illustrates another thermal insulator cabinet 1 as a third embodiment according to the present invention, in which heat exchange is carried out between a heat discharging portion of a thermal system with a compressor and a gas-storage container.

The differences of the thermal insulator cabinet 1 of the third embodiment from that of the second embodiment are that the conduit 10 is connected to the compressor 7 and that the condensation pipe 8 connecting with a discharge conduit 16 from the compressor 7 exchanges heat with the gas-storage container 4. A coolant of high-temperature, high-pressure gas is discharged from the compressor 7 and discharges heat in the condensation pipe 8, which is subjected to a heat exchange with the gas-storage container 4, to the coolant of high-pressure, over-cooled liquid. The coolant goes through an expansion process, such as the capillary pipe 17, to the low-pressure, two-phase coolant, which absorbs heat in the evaporator 9 and cools down the thermal insulator cabinet 1. The low-pressure heated gas coolant is eventually taken into the compressor 7.

In this embodiment, a chemical absorbent is mainly used as the gas-absorbing material 5. The gas-storage container 4 filled with the chemical absorbent is continuously heated through the heat exchange with the thermal system to accelerate the chemical reaction. This structure enables the charging gas used for charging the thermal insulator into the gas-tight container 2, the air, and the organic-component gases newly evolved to be efficiently stored into the gas-storage container 4. This keeps the gas-tight container 2 in the state of reduced pressure over a long time period.

In the second and the third embodiments, the arrangement of heat exchange between the gas-storage container and the thermal system depends upon the type of the gas-absorbing material. The arrangement of heat exchange is, however, not restricted to these combinations. By way of example, similar effects can be exerted in a modified structure that cools down or heats the gas-storage container by the combined use of a physical absorbent and a chemical absorbent. Excellent effects can also be assured in another modified structure with two gas-storage containers. In this structure, the first gas-storage container filled with a physical absorbent as the gas-absorbing material is subjected to a heat exchange with a heat absorbing portion of the thermal system, whereas the second gas-storage container filled with a chemical absorbent is subjected to a heat exchange with a heat discharging portion of the thermal system.

Fourth Embodiment

Figure 5:
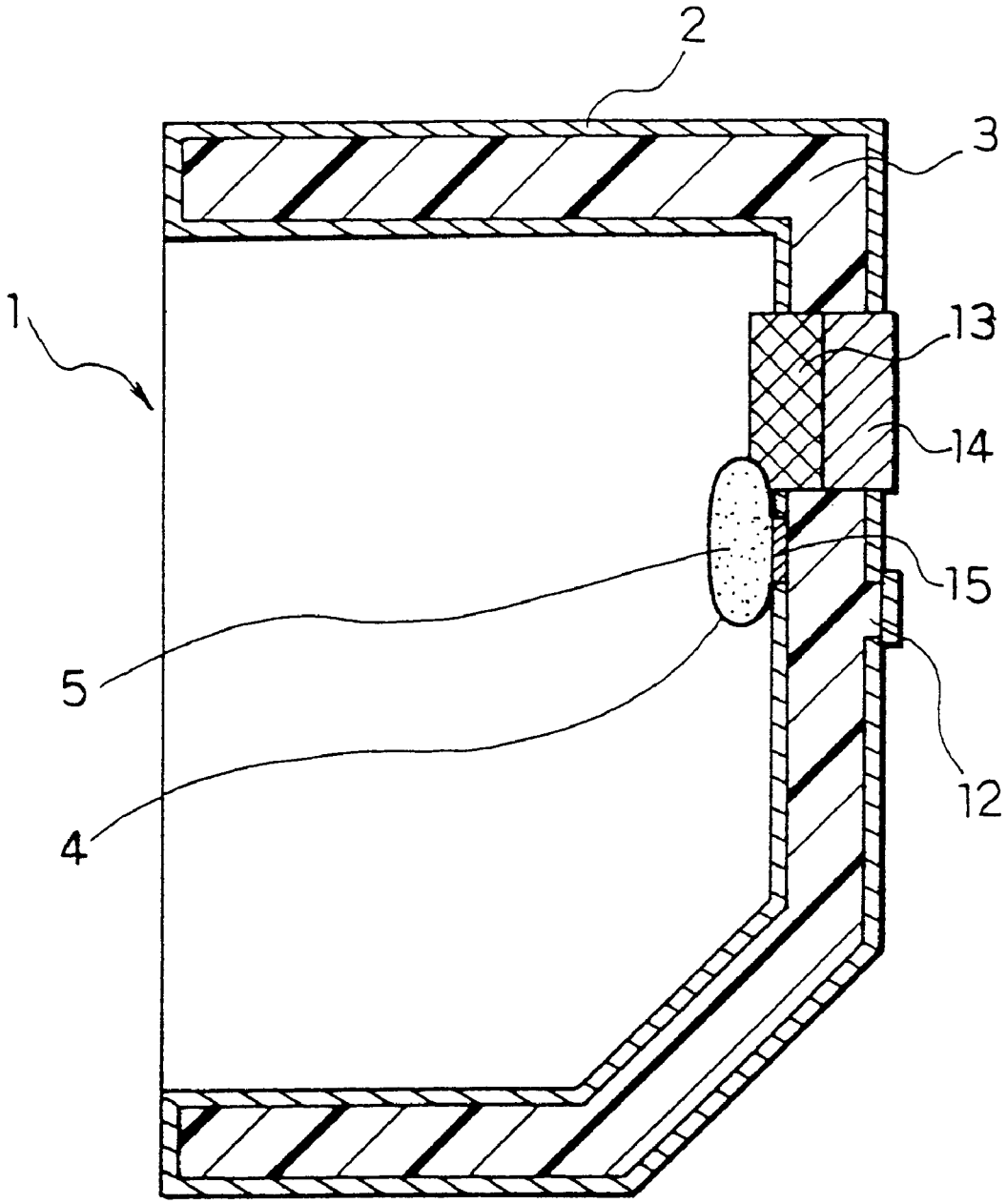
FIG. 5 is a cross sectional view illustrating a thermal insulator cabinet for the refrigerating purpose as a fourth embodiment according to the present invention.

FIG. 5 illustrates a thermal insulator cabinet 1 for the refrigerating purpose, in which heat exchange is carried out between a heat absorbing portion of a thermal system by a thermoelectric transducer.

In this thermal insulator cabinet 1, a gas-tight container 2 is filled with a continuous-spacing insulator 3, and a gas-storage container 4 filled with a gas-absorbing material 5 is connected to the gas-tight container 2 via a gas-permeable sheet 15. The thermal system used here takes advantage of a thermoelectric transducer of Pelloutier effect including a heat absorbing section 13 and a heat discharging section 14. The gas-storage container 4 is in contact with the heat absorbing section 13 for cooling the inside of the thermal insulator cabinet 1. The heat exchange between the gas-storage container 4 and the heat absorbing section 13 structure enables the charging gas used for charging the thermal insulator into the gas-tight container 2, the air, and the organic-component gases newly evolved to be efficiently stored into the gas-storage container 4. This keeps the gas-tight container 2 in the state of reduced pressure over a long time period.

Fifth Embodiment

Figure 6:
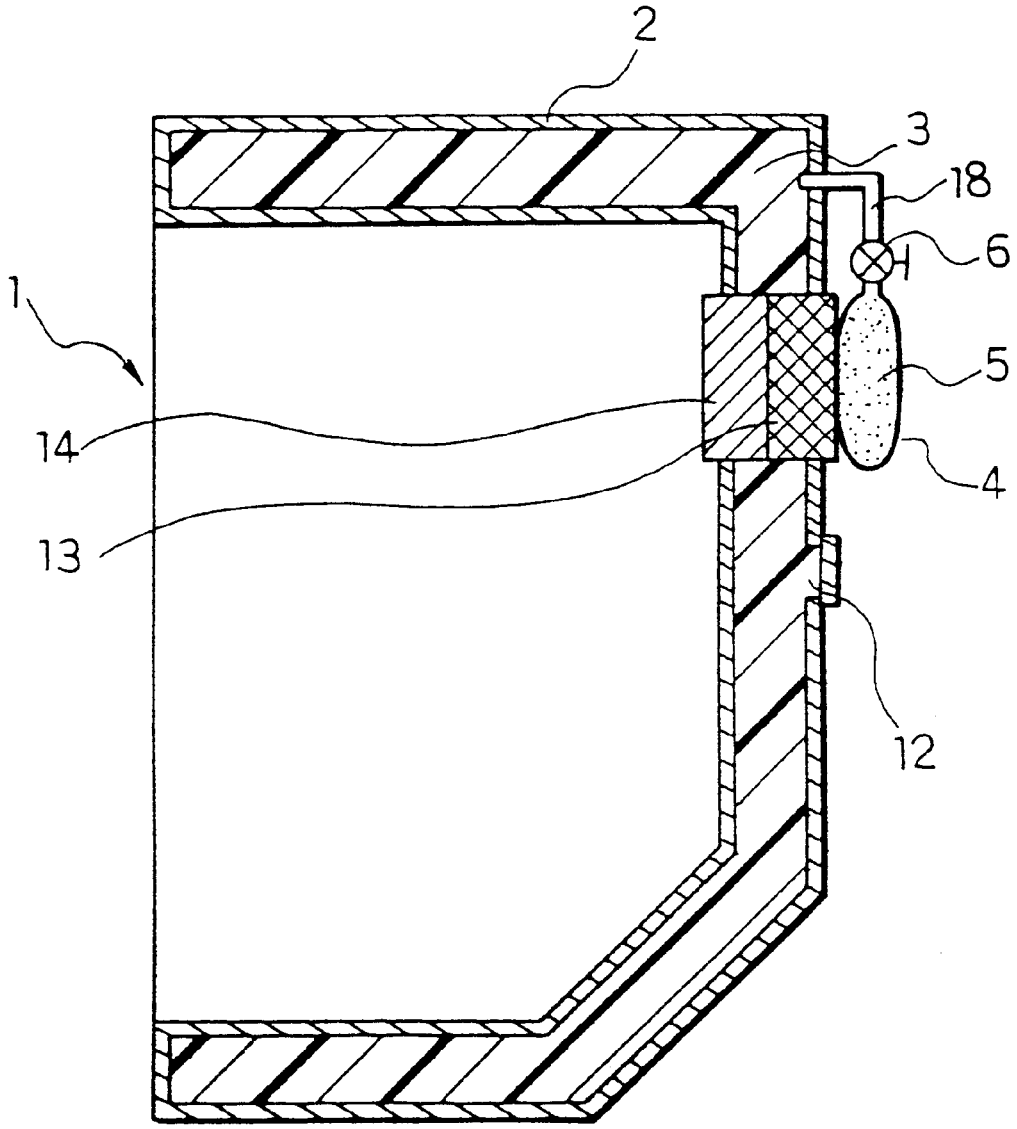
FIG. 6 is a cross sectional view illustrating a thermal insulator cabinet for the heat insulating purpose as a fifth embodiment according to the present invention.

FIG. 6 illustrates a thermal insulator cabinet 1 for the heat insulating purpose, in which heat exchange is carried out between a heat absorbing portion of a thermal system by a thermoelectric transducer.

There are the following differences from the fourth embodiment. The thermal system heats the inside of the thermal insulator cabinet 1 by a thermoelectric transducer of Pelloutier effect including a heat absorbing section 13 and a heat discharging section 14. The gas-storage container 4 disposed outside the thermal insulator cabinet 1 is in contact with the heat absorbing section 13 also disposed outside the cabinet 1 for heat exchange. The gas-storage container 4 is connected to the gas-tight container 2 via a pipe 18 with an on-off valve 6. Like the fourth embodiment, the structure of the fifth embodiment keeps the gas-tight container 2 in the state of reduced pressure over a long time period.

Sixth Embodiment

Figure 7:
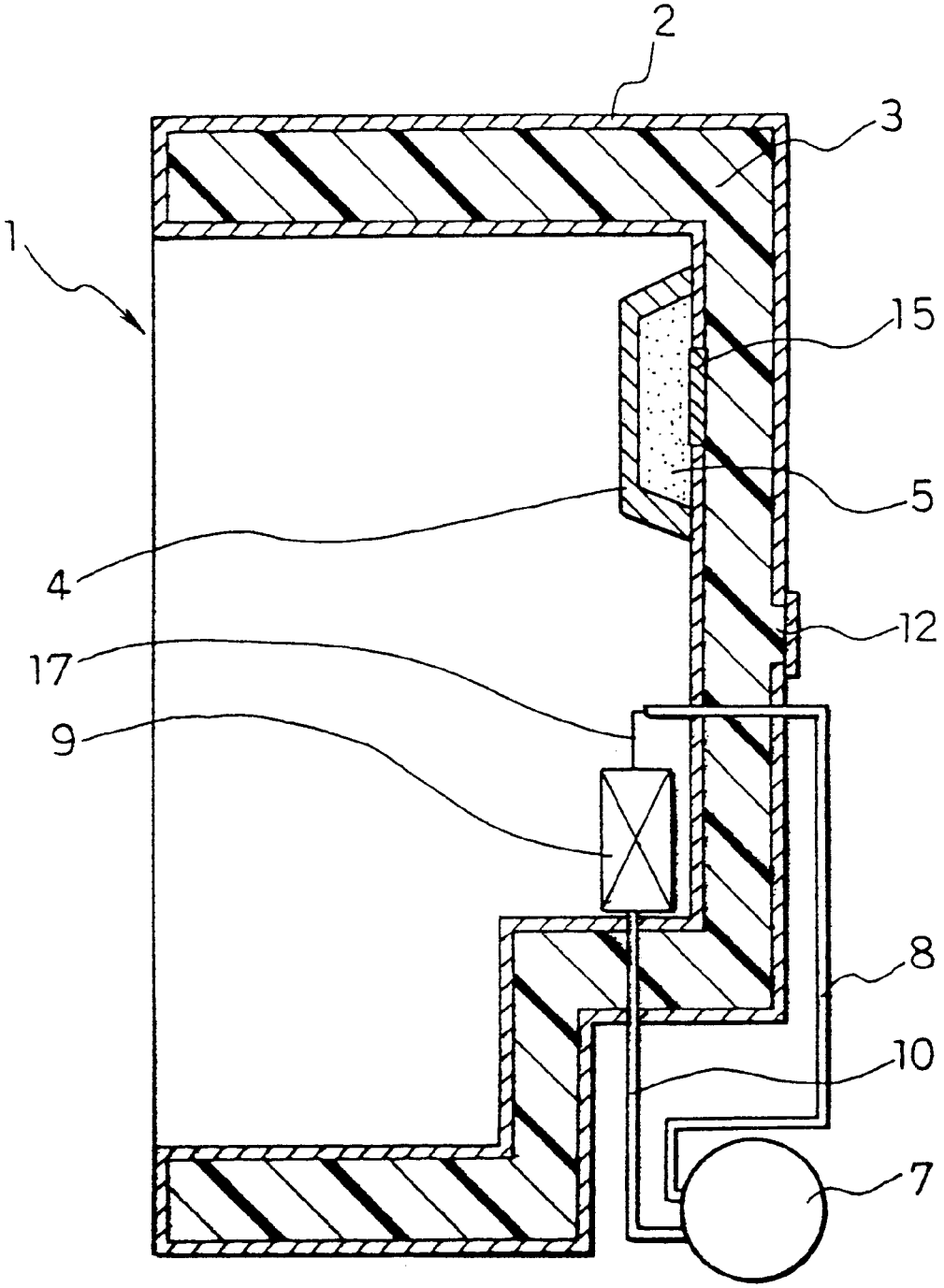
FIG. 7 is a cross sectional view illustrating another thermal insulator cabinet as a sixth embodiment according to the present invention.

FIG. 7 illustrates another thermal insulator cabinet 1, which is cooled by a thermal system with a compressor and in which a gas-storage container is arranged.

The thermal insulator cabinet 1 includes a gas-tight container 2 filled with a continuous-spacing insulator 3, a gas-storage container 4 filled with a gas-absorbing material 5 and connected to the gas-tight container 2 via a gas-permeable sheet 15, and a thermal system. The thermal system includes a compressor 7, a condensation pipe 8, a capillary pipe 17, and an evaporator 9. The evaporator 9 absorbs heat to cool down the thermal insulator cabinet 1. Since the gas-storage container 4 filled with the gas-absorbing material 5 is disposed inside the cooled cabinet 1, the gas-storage container 4 is also cooled down, so as to enable a gas to be efficiently stored in the gas-storage container 4. This keeps the gas-tight container 2 in the state of reduced pressure over a long time period.

The gas-tight container 2 is connected with the gas-storage container 4 via any structure that does not allow the thermal insulator 3 to be charged into the gas-storage container 4 and ensures sufficient charge of the thermal insulator 3 into the gas-tight container 2; for example, a pipe, a pipe with an on-off valve, or a gas-permeable material.

The thermal insulator cabinet 1 may have an arbitrary shape other than the quadratic prism, for example, cylindrical, spherical, or basin-like shape.

The following describes the method of manufacturing the thermal insulator cabinet 1 second embodiment with the drawing of FIG. 3.

Before the thermal insulator 3 is charged into the gas-tight container 2, the thermal insulator cabinet 1 including the gas-tight container 2, the gas-storage container 4, and the thermal system as shown in FIG. 3 is manufactured. The thermal insulator 3 is charged into the gas-tight container 2 through the inlet 12 formed in the gas-tight container 2 with the charging gas. The inlet 12 is then sealed and the gas-tight container 2 is evacuated.

Several techniques including (1) and (2) discussed below are applicable to reduce the pressure of the gas-tight container 2.

(1) The gas-tight container 2 is evacuated to a certain degree of vacuum with a vacuum pump. The gas-tight container 2 is then connected to the gas-storage container 4, which absorbs the remaining gas in the gas-tight container 2 to improve and maintain the state of reduced pressure.

(2) After the process of charging the thermal insulator 3 into the gas-tight container 2 with the charging gas is completed, the gas-tight container 2 is connected to the gas-storage container 4. This causes the charging gas existing in the gas-tight container 2 to be stored into the gas-storage container 4 and makes and keeps the gas-tight container 2 in the state of reduced pressure. This method does not use a vacuum pump.

The timings of charging the thermal insulator 3, evacuating the gas-tight container 2, and connecting the gas-tight container 2 with the gas-storage container 4 are determined, for example, according to the shape of the thermal insulator cabinet, the type of the thermal insulator 3, and the arrangement of the thermal system. The gas-storage container 4 functions to make the gas-tight container 2 in the state of reduced pressure and to maintain the state of reduced pressure. The difference between the techniques (1) and (2) discussed above is whether the first role of the gas-storage container 4 (making the state of reduced pressure) is predominant or auxiliary. Although the thermal insulator is charged into the gas-tight container previously manufactured in this embodiment, charging the thermal insulator may be carried out simultaneously with the manufacture of the gas-tight container.

Activation of the thermal system improves the state of reduced pressure and accelerates the storage of the gas into the gas-storage container 4.

This manufacturing method gives the thermal insulator cabinet of excellent vacuum insulating ability integrated with the container.

When the vacuum pump is used for evacuation after the charging process of the thermal insulator, the amount of the gas-absorbing material charged in the gas-storage container should correspond to the amount of the remaining air and the newly evolved gas components in the gas-tight container. When the gas-storage container functions to store the charging gas as well as the other gases and make the gas-tight container in the state of reduced pressure, on the other hand, the amount of the gas-absorbing material should correspond to the sum of the amount of the charging gas and the amount of the remaining air and the newly evolved gas components in the gas-tight container. Both the structures effectively keep the state of reduced pressure without using a vacuum pump for that purpose. This method provides a high-performance and energy-saving thermal insulator cabinet having the high reliability of thermal insulating ability.

The following describes the materials for the components of the thermal insulator cabinet of the present invention.

Examples of the material used for the gas-tight container include metal materials, such as steel, copper, aluminum, and stainless steel, and inorganic materials, such as glass and ceramics, which are processed to keep the state of reduced pressure. Available organic materials which have the high gas-barrier property include fluorocarbon resins such as Teflon, vinyl alcohol resins such as ethylene-vinyl alcohol copolymer, acrylonitrile resins such as polyacrylonitrile, vinylidene chloride resins, polyamide resins such as nylon, and polyester resins such as polyethylene terephthalate. These resins may be used alone or in the laminate form. These resins may be covered with a metal layer, a silicon oxide layer, or an aluminum oxide layer, for example, through vapor deposition, for the purpose of enhancing the gas barrier property. These materials may be combined to construct the container of the high degree of gas tightness.

Since the gas-tight container is filled with the thermal insulators and is not required to have the compression strength against the state of reduced pressure by itself, the wall of the container may be relatively thin. The required strength of the container is not less than 1 kg weight per unit area in the course of charging the thermal insulators. This decreases the weight and improves the durability and cost performance. The required thickness of the container depends upon the type of the thermal insulators charged therein, but may be not greater than 1 mm. Even the thickness of approximately 100 μm may be sufficient. The structure of the gas-tight container is processed to have sufficient gas tightness.

The thermal insulators charged in the gas-tight container may be powder, fibers, foamed bodies, porous bodies, or any other known substances. Although the thermal insulators may have a closed-cell structure, the continuous-spacing structure is favorable because its smaller pressure loss of the gas implements the evacuation from and the gas storage in the gas-tight container filled with the thermal insulators within a short time period.

It is preferable that the mean gap distance of the continuous-spacing insulator in the charged state is not greater than the mean free path of the charging gas at 20° C. and 1/100 atmospheric pressure. The thermal conduction by the gas is sufficiently small in the gap distance of this range. The favorable thermal insulating performance can be obtained even when the gas-tight container is not in the state of high degree of vacuum, for example, even at the degree of vacuum of approximately 1/100 atmospheric pressure. When the air, nitrogen, oxygen, carbon dioxide, and steam are used as the charging gas, it is suitable that the mean gap distance of the continuous-spacing core is respectively not greater than 6.42 μm, 6.42 μm, 6.81 μm, 4.24 μm, and 4.24 μm. The continuous-spacing core is composed of the material having the mean gap distance of the above range.

The available materials of the continuous-spacing insulator are classified into three groups. The first group includes inorganic powders such as silica, pearlite, and alumina, resin powders such as poly(vinyl alcohol) and polyurethane, and fine porous bodies such as aerogels and xerogels, which are especially preferable. The second group includes inorganic and organic fibers. The third group includes injection foamed objects of open-cell or semi-open-cell structure such as polyurethane foam and polycarbodiimide foam, and expanded particle objects of open-cell or semi-open-cell structure such as polystyrene foam or vinylidene chloride resin foam. Any material that can be charged into the gas-tight container to form the continuous-spacing structure may, however, be applicable.

The air components are generally used as the charging gas for charging the thermal insulators into the gas-tight container, although other gases that are more readily stored may also be applicable. The air in the gas-tight container may be substituted by another gas before the charging process, or only a specific charging gas may be used for the charging process. Available charging gases, though not being restricted, include air components such as carbon dioxide, steam, oxygen, and nitrogen, fluorocarbon compounds, lower alcohols such as methanol and ethanol, hydrocarbons such as cyclopentane and butane, and inorganic gases such as sulfur hexafluoride. Any compound in the gas state at ordinary temperature and ordinary pressure or low boiling-point compound having the high vapor pressure may be used as the charging gas. These gases may be used alone or in combination. The preferable charging gas is those readily diffused, relatively easily adsorbed, and relatively reactive. Carbon dioxide, steam, and oxygen are thus suitable. The charging gas may be produced through a chemical reaction in the gas-tight container to charge the continuous-spacing cores therein, or may physically act to charge the continuous-spacing cores in the container. The charging gas, for example, may be in the gas state, the liquefied state, or the supercritical fluid state. The appropriate state of the charging gas is selected according to the type of the continuous-spacing cores.

The thermal insulators charged in the gas-tight container are not required to have the continuous-spacing structure when the charging gas is any one of such gases readily diffusing in the solid. The continuous-spacing insulators are, however, preferable because of the higher speed of gas storage.

The material of the gas-storage container may be identical with that of the gas-tight container. Heating, evacuating, or another process may be required to remove the gas from the gas-storage container, before the gas-storage container filled with the gas-absorbing material is attached to the thermal insulator cabinet. Metal is accordingly the preferable material for the gas-storage container. The gas-storage container is readily detached from the thermal insulator cabinet, when the thermal insulator cabinet is not in service. The gas-absorbing material in the gas-storage container can be recycled and reused. Namely the gas-storage container of the present invention has the environment-conscious structure.

The gas-absorbing material charged in the gas-storage container may be a mixed absorbent for absorbing the charging gas in the gas-tight container, the remaining gas components, and newly evolved gases. The remaining gas components are generally the air components. It is accordingly preferable that the mixture includes absorbents of the air components, that is, nitrogen, oxygen, carbon dioxide, steam, and argon. The newly evolved gases include the adsorbed gas components existing in the inner wall of the gas-tight container and the thermal insulators as well as the gas components produced from the thermal insulators. The adsorbed gas components are generally the air components, and the produced gas components are generally carbon dioxide, steam, and organic compound gases.

Known physical and chemical gas absorbents can be used as the gas-absorbing material.

Typical examples of the physical carbon dioxide-absorbent include molecular sieves, zeolite, and active carbon, whereas the chemical carbon dioxide-fixing agent may be an inorganic metal compound or an organic compound. The inorganic metal compound is those reacting with carbon dioxide to produce metal carbonates or metal hydrogencarbonates. Typical examples include metal hydroxides such as soda ash, sodium hydroxide, potassium hydroxide, calcium hydroxide, barium hydroxide, and magnesium hydroxide, metal oxides such as calcium oxide and magnesium oxide, and metal carbonates such as potassium carbonate and sodium carbonate. These compounds often require water for the reaction or produce water through the reaction, and are thus favorably combined with a water absorbent.

The organic compounds used as the carbon dioxide-fixing agent include ethanol amine compounds and solid substances with free amino groups carried thereon. The addition reaction to epoxy compounds is also applicable because of the high reaction yield. Concrete examples include monofunctional or polyfunctional epoxy compounds such as epoxyethane, 1,2-epoxypropane, 1,2-epoxybutane, 2,3-epoxybutane, 1,2-epoxyhexane, 1,2-epoxyoctane, 3,4-epoxy-1-propene, styrene oxide, cyclohexene oxide, glycidyl phenyl, and perfluoropropylene oxide; glycidyl esters such as glycidyl acetate, glycidyl propionate, and diglycidyl adipate; glycidyl ethers such as phenyl glycidyl ether, trimethylsilyl glycidyl ether, resorcinol diglycidyl ether, and aryl glycidyl ether; and other general-purpose epoxy compounds.

The presence of a reaction catalyst, such as an organic zinc compound, a magnesium catalyst, or an onium salt, enables the epoxy compound to absorb carbon dioxide at a higher reaction selectivity.

Concrete examples of the reaction catalyst include one-to-one (molar ratio) compounds of dialkylzinc or dialkylmagnesium and a divalent active hydrogen compound such as water, a primary amine, a divalent phenol, an aromatic dicarboxylic acid, or an aromatic hydroxycarboxylic acid; combinations of organozinc catalysts and inorganic catalysts such as diethylzinc/γ-alumina, zinc carbonate, zinc acetate, cobalt acetate, zinc chloride/tetrabutylammonium bromide; aluminum compound catalysts such as triethylaluminum/Lewis base catalysts, diethylaluminum diethylamide, α, β, γ, δ-tetraphenylporphinatoaluminum methoxide; and onium salt catalysts such as ammonium halides and phosphonium halides.

Other available examples of the carbon dioxide-fixing organic compound include cyclic imines such as propylene imine; four-member ring ethers such as oxetane; formaldehyde; three-member ring amines such as methyl aziridine; conjugated dienes such as butadiene and isoprene; propylene sulfide, ethylene phenylphosphite; mixtures of a phosphate and an aromatic primary amine or an aromatic diamine; and mixtures of a crown ether, an alkyl dihalide, and a metal dialkoxide.

Zeolite, molecular sieves, calcium chloride, calcium oxide, calcium sulfide, magnesium sulfate anhydride, water-absorbing polymers, and other generally known water absorbents of hygroscopic or water-absorbing properties may be used as the water-absorbing material.

Iron deoxidation agents such as iron powder and iron(II) sulfate anhydride, titanium deoxidation agents, magnesium deoxidation agents, and salcomine cobalt complexes may be used as the oxygen absorbent.

Available examples of the nitrogen absorbent include lithium, barium, titanium, zirconium alloys, and lithium-barium alloys, which are generally used as the getter.

Palladium fine powder may be used as the hydrogen absorbent.

Molecular sieves can be used for absorbing rare gases, such as argon.

Active carbon, molecular sieves, zeolite, silica, and alumina may be used for absorbing the organic gas components.

The absorbing material is not restricted to the above examples. Since some of the above absorbents have the absorption ability for a plurality of gas components, the appropriate absorbing material is determined by taking into account the charging gas and other parameters. For example, physical absorbents, such as molecular sieves, zeolite, and active carbon, can adsorb all the gas components. The absorption capacity of these physical absorbents is enhanced by cooling the absorbents through a heat exchange with the thermal system. The absorption capacity of chemical absorbents for oxygen, carbon dioxide, water, and nitrogen is enhanced, on the other hand, by heating the absorbents through a heat exchange with the thermal system.

Mixed use of the physical absorbents and the chemical absorbents is also sufficiently effective. For example, a mixture prepared by carrying a chemical absorbent on a physical absorbent enables the gas once physically adsorbed to be further subjected to the chemical reaction. Because of the characteristic of the equilibrium state between the adsorption and desorption of gases, the combined use accelerates the adsorption. In this case, even a simple mixture exerts the sufficient effects.

The activation process after charging the gas-absorbing material into the gas-storage container further enhances the effects.

Since cells and minute spaces between powders exist in the gas-tight container, the state of reduced pressure kept through the gas storage process does not require such a high degree of vacuum as equal to or less than $10^{-5}$ torr for the high thermal insulating performance, unlike the vacuum insulation without any such spaces. Although the required degree of vacuum depends upon the structure of the thermal insulators, the range of relatively low to medium degrees of vacuum, for example, several to $10^{-3}$ torr, is sufficient for the excellent thermal insulating performance. The gas storage process maintains this range of vacuum over a long time period, which results in the high reliability.

The connection of the gas-tight container with the gas-storage container may be realized by piping, a partition, or a gas-permeable material. When piping is applied for the connection, a conventional on-off valve may be disposed in the piping. The on-off valve is used to realize the required state of reduced pressure after the thermal insulators are sufficiently charged into the gas-tight container. The on-off valve is opened after completion of the charging and forming process, so that the evacuation process can be separate from the charging and forming process in the time line. When the gas-permeable material is applied for the connection, a conventional polymer sheet or non-woven fabric may be used as the gas-permeable material. The polymer sheet applied herein does not have the high gas-barrier property but has a relatively low density and high gas permeability; for example, polyester, polystyrene, and polyolefins.

Figure 2:
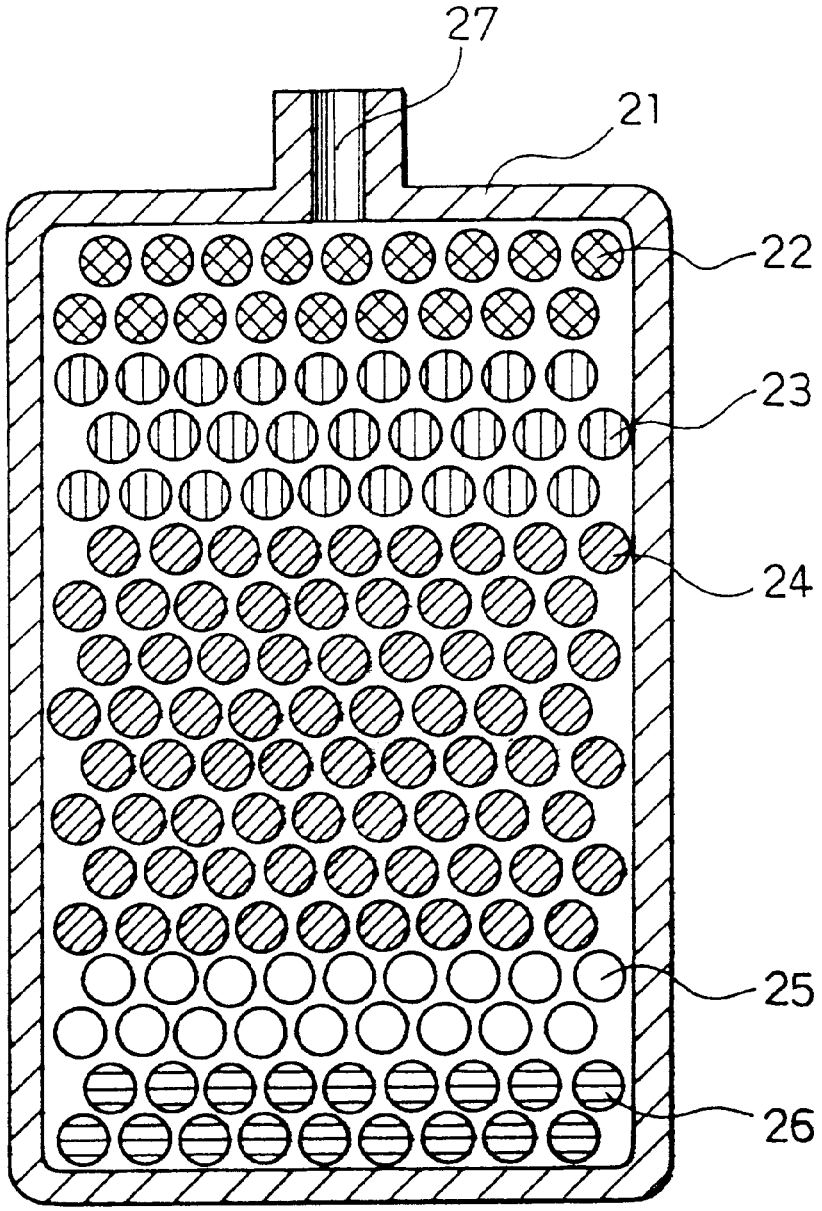
FIG. 2 schematically illustrates structure of a gas-storage container when carbon dioxide is used as a charging gas in the first embodiment of the present invention.

FIG. 2 illustrates internal structure of a preferable gas-storage container 21 using zeolite as the carbon dioxide-fixing agent. Nitrogen is an inert gas. A lithium-barium alloy functioning as a nitrogen absorbent 26 is active to the other gas components and is thereby placed in the innermost recess of the container. An oxygen absorbent 25 and a carbon dioxide-fixing agent 24 are successively charged after the nitrogen absorbent 26. Since zeolite functioning as the carbon dioxide-fixing agent 24 lowers its absorption ability of carbon dioxide in the presence of water, a water absorbent 23, such as calcium chloride, is charged after the carbon dioxide-fixing agent 24 in order to remove the water content prior to fixation of carbon dioxide. Active carbon functioning as an adsorbent 22 of organic gas components is charged near the inlet of the container, in order to prevent the other gas-absorbing materials from being inactivated by the organic gas components. In case that a metal hydroxide, such as calcium hydroxide, is used as the carbon dioxide-fixing agent 24, however, since water is produced as a by-product of the reaction, the carbon dioxide-fixing agent 24 should be mixed with the water absorbent 23. Namely the internal structure of the container depends upon the gas-absorbing materials selected. The gas-storage container 21 is provided with an inlet 27, which connects with the gas-tight container.

The following describes a process of manufacturing the thermal insulator cabinet of the present invention.

In a preferred embodiment, the gas-tight container and the gas-storage container are prepared and connected to each other in advance. The charging process of the continuous-spacing cores into the gas-tight container depends upon the material and structure of the continuous-spacing cores. The inlet is sealed after the sufficient charge of the continuous-spacing cores into the gas-tight container. In case that the charging gas only functions to charge the continuous-spacing cores, such as powder, into the gas-tight container, the flow of the charging gas or the liquefied charging gas may be utilized for the charging process. The charging gas should also work as the blowing gas when the expandable material is charged into the gas-tight container.

After or during the charging and forming process, the gas storage process starts. When the gas-permeable sheet is applied for the connection, the gas storage starts in the course of the charging and forming process. The evacuation, however, starts after completion of the charging and forming process. This ensures sufficient formation. When an on-off valve is disposed in the piping, the on-off valve is opened after completion of the charging and forming process, so that the evacuation process can be separate from the charging and forming process in the time line. The thermal insulators exert the sufficient effects after the evacuation of the gas-tight container through the gas storage process has been completed.

Concrete examples of the present invention are given below.

EXAMPLE 1

As shown in FIG. 1, a stainless steel gas-storage container 4 was connected to a gas-tight container 2 of stainless steel plate having a thickness of 0.5 mm via a stainless steel pipe 18 with a valve 6. The gas-storage container 4 was filled with gas-absorbing materials including an absorbent of the charging gas or carbon dioxide as shown in FIG. 2.

An urethane material including a polyol, an urethane catalyst, a foam stabilizer, an antifoamer, water, and an isocyanate was injected through an inlet 12 into the gas-tight container 2, and carbon dioxide produced through the reaction of the isocyanate with water was utilized for the foam molding process. The water-blown urethane foam was hard and had an open-cell structure being completely continuous by the addition of the antifoamer and filled with carbon dioxide. The gas-tight container 2 with the urethane foam therein was cured at approximately 40° C. This process completely cured the urethane foam to urethane foam resin and completed the continuous-spacing cores having the foam strength per unit area of not lower than 1 kg weight. The valve 6 was then opened to cause carbon dioxide existing in the cells to be absorbed and stored in the gas-storage container 4. This made the gas-tight container 2 in the state of reduced pressure.

The degree of vacuum measured with a vacuum gauge attached to the valve 6 was approximately 0.1 torr. This proved production of a vacuum insulator cabinet of excellent thermal insulating ability.

The thermal insulating ability of the resulting thermal insulator cabinet 1 was approximately twice as high as the thermal insulating ability of the cabinet 1 filled with carbon dioxide prior to the gas storage process. The sufficient thermal insulating ability was maintained over a long time period.

EXAMPLE 2

In a thermal insulator cabinet shown in FIG. 1, a gas-tight container included an outer box of iron plate and an inner box of ABS (acrylonitrile-butadiene-styrene) resin-aluminum laminate structure. An iron gas-storage container was connected to the gas-tight container via an iron pipe with a valve. An epoxy compound, a catalyst for the addition reaction of carbon dioxide with the epoxy compound, and calcium hydroxide were filled with the gas-storage container as the absorbing materials of the charging gas or carbon dioxide. Calcium chloride was added to the gas-absorbing materials to trap water produced through the reaction of calcium hydroxide with carbon dioxide.

Pearlite powder stored in the atmosphere of carbon dioxide was charged into the gas-tight container through the inlet under pressure. The valve was then opened to cause carbon dioxide existing in the cells to be absorbed and stored in the gas-storage container. This made the gas-tight container in the state of reduced pressure. The degree of vacuum measured with a vacuum gauge attached to the valve was approximately 1 torr. This proved production of a vacuum insulator cabinet of excellent thermal insulating ability.

The thermal insulating ability of the resulting thermal insulator cabinet was approximately 1.8 times as high as the thermal insulating ability of the cabinet filled with carbon dioxide prior to the gas storage process.

EXAMPLE 3

A thermal insulator cabinet for the thermal insulating purpose included a stainless steel cylindrical gas-tight container. A stainless steel gas-storage container was connected to the stainless steel gas-tight container via a stainless steel pipe with a valve. Zeolite as the absorbing material of the charging gas or carbon dioxide, a lithium-barium alloy as the absorbing material of the air components, and active carbon as the adsorbent of the water content and organic gases were filled with the gas-storage container.

Polyethylene terephthalate particles impregnated with carbon dioxide as a blowing agent were charged with carbon dioxide into the gas-tight container through the inlet. The container was heated to the temperature of above 150° C. to expand the polyethylene terephthalate particles. The amount of the expandable particles was less than the quantity causing the container to be completely filled with the expanded object, and the expanded object had the continuous-spacing structure. After the charging process, the valve was opened to cause carbon dioxide existing in the cells to be absorbed and stored in the gas-storage container. This made the gas-tight container in the state of reduced pressure. The degree of vacuum measured with a vacuum gauge attached to the valve was approximately 1 torr. This proved production of a vacuum insulator cabinet of excellent thermal insulating ability.

The thermal insulating ability of the resulting thermal insulator cabinet was approximately twice as high as the thermal insulating ability of the cabinet filled with carbon dioxide prior to the gas storage process. The sufficient thermal insulating ability was maintained over a long time period.

Comparative Example 1

The gas-tight container of Example 1, which was not filled with the continuous-spacing cores, was directly evacuated with a vacuum pump. The container was compressed and crushed.

After the container was reinforced, the resulting cabinet was further evacuated for one hour with a vacuum pump to 0.01 torr. The degree of vacuum did not reach the level of $10^{-5}$ torr that ensured sufficient vacuum insulation. The cabinet accordingly did not have sufficient thermal insulating performance.

Comparative Example 2

Water-blown open-cell hard urethane foam was charged into the gas-tight container of Example 1. The gas-tight container was directly evacuated with a vacuum pump to 0.01 torr. This structure improved the thermal insulating performance. The degree of vacuum, however, increased after one week, and it was required to re-evacuate the container with a vacuum pump. This structure accordingly had the low long-term reliability.

EXAMPLE 4

A thermal insulator cabinet having the structure shown in FIG. 3 was manufactured. A gas-tight container 2 was composed of stainless steel plate having a thickness of 0.5 mm. A stainless steel gas-storage container 4 was connected to the gas-tight container 2 via a stainless steel pipe 18 with a valve 6. A gas-absorbing material 5 including molecular sieves, active carbon, and calcium chloride were filled with the gas-storage container 4. The gas-storage container was exposed to the piping from an evaporator of a thermal system for heat exchange and cooled to be lower than the room temperature.

Pearlite powder was injected into the gas-tight container 2 through an inlet 12 to form continuous-spacing insulators 3. After the inlet 12 of the container 2 was sealed, the valve 6 was opened, and the gas-storage container 4 worked to make the gas-tight container 2 in the state of reduced pressure. The degree of vacuum measured with a vacuum gauge attached to the valve was approximately 1 torr. This proved production of a vacuum insulator cabinet of excellent thermal insulating ability. Activation of the thermal system cooled down the gas-storage container 4 through the heat exchange. This enhanced the efficiency of gas absorption and improved and maintained the degree of vacuum to 0.5 torr.

The thermal insulating ability of the resulting thermal insulator cabinet was approximately twice as high as the thermal insulating ability of the cabinet without evacuation. The sufficient thermal insulating ability was maintained over a long time period.

EXAMPLE 5

A thermal insulator cabinet having the structure shown in FIG. 4 was manufactured. A gas-tight container 2 included an outer box of iron plate and an inner box of ABS (acrylonitrile-butadiene-styrene) resin-aluminum laminate structure. An iron gas-storage container 4 was connected to the gas-tight container 2 via an iron pipe 18 with a valve 6. A carbon dioxide-fixing agent including an epoxy compound, a catalyst for the addition reaction of carbon dioxide with the epoxy compound, and calcium hydroxide for chemically absorbing carbon dioxide, calcium chloride for trapping water produced through the reaction of calcium hydroxide with carbon dioxide, and active carbon for physically adsorbing the remaining organic compound gases were filled with the gas-storage container 4. The gas-storage container 4 was exposed to the piping from the outlet of the compressor 7 of the thermal system and heated to be higher than the room temperature.

An urethane material including a polyol, an urethane catalyst, a foam stabilizer, an antifoamer, water, and an isocyanate was injected through an inlet 12 into the gas-tight container 2, and carbon dioxide produced through the reaction of the isocyanate with water was utilized for the foam molding process. The water-blown urethane foam was hard and had an open-cell structure being completely continuous by the addition of the antifoamer and filled with carbon dioxide. The gas-tight container 2 with the urethane foam therein was cured at approximately 40° C. This process completely cured the urethane foam to urethane foam resin and completed the continuous-spacing cores having the foam strength per unit area of not lower than 1 kg weight. The valve 6 was then opened to cause carbon dioxide existing in the cells to be absorbed and stored in the gas-storage container 4. This made the gas-tight container 2 in the state of reduced pressure. Activation of the thermal system further improved the degree of vacuum. The degree of vacuum measured with a vacuum gauge attached to the valve 6 was not greater than approximately 0.1 torr. This proved production of a vacuum insulator cabinet of excellent thermal insulating ability.

The thermal insulating ability of the resulting thermal insulator cabinet was approximately 1.8 times as high as the thermal insulating ability of the cabinet filled with carbon dioxide prior to the gas storage process.

EXAMPLE 6

A thermal insulator cabinet having the structure shown in FIG. 5 was manufactured. A gas-tight container 2 for the refrigerating purpose was composed of stainless steel plate having a thickness of 0.5 mm, and a thermoelectric transducer of Pelloutier effect was attached to the gas-tight container 2 in such a manner that a heat absorbing section 13 faced to the inside of the container 2. The gas-tight container 2 was connected to a stainless steel gas-storage container 4 via a gas-permeable sheet 15. The gas-storage container 4 was filled with zeolite and a gas-absorbing material primarily composed of zeolite with sodium hydroxide carried thereon. The gas-storage container 4 was exposed to the heat absorbing section 13 of the thermoelectric transducer and cooled to be lower than the room temperature in the gas-tight container 2.

Ground powder of urethane foam was injected with carbon dioxide into the gas-tight container 2 via an inlet 12 to form the continuous-spacing insulators 3. After the gas-tight container 2 was evacuated with a vacuum pump, the container 2 was sealed in the state of reduced pressure. The gas-storage container 4 kept the gas-tight container 2 in the state of reduced pressure. The thermal insulating ability of the resulting thermal insulator cabinet was approximately twice as high as the thermal insulating ability of the cabinet without evacuation. While the thermal insulating ability was lowered in a few days in the structure without the gas-storage container, the structure of Example 6 ensured the thermal insulating ability over a long time period.

EXAMPLE 7

A thermal insulator cabinet having the structure shown in FIG. 6 was manufactured from the same materials as those of Example 6. The gas-storage container 4 was subjected to a heat exchange with the heat absorbing section 13 of the thermoelectric transducer. This structure also ensured the high vacuum insulation performance and the thermal insulating ability over a long time period.

EXAMPLE 8

A thermal insulator cabinet having the structure shown in FIG. 7 was manufactured. A gas-tight container 2 of stainless steel plate having a thickness of 0.3 mm was connected to a stainless steel gas-storage container 4 via a non-woven fabric 15. The gas-storage container 4 was filled with a gas-absorbing material including molecular sieves, active carbon, and calcium chloride. The gas-storage container 4 was cooled by the evaporator 9 of the thermal system in the thermal insulator cabinet.

Porous aerogel powder was charged with carbon dioxide into the gas-tight container 2 via an inlet 12 to form the continuous-spacing insulators 3. After the inlet 12 of the gas-tight container 2 was sealed, the gas-tight container 2 was made in the state of reduced pressure through absorption of carbon dioxide. The degree of vacuum measured with a vacuum gauge attached to the valve was approximately 1 torr. This proved production of a vacuum insulator cabinet of excellent thermal insulating ability. Activation of the thermal system started heat exchange with the gas-storage container 4 and improved the adsorption efficiency through the cooling process. This improved and maintained the degree of vacuum to approximately 0.5 torr.

The thermal insulating ability of the resulting thermal insulator cabinet was approximately twice as high as the thermal insulating ability of the cabinet without evacuation. The sufficient thermal insulating ability was maintained over a long time period.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A thermal insulator cabinet comprising a gas-tight container that is filled with carbon dioxide gas and a continuous-spacing core, and a gas-storage container that communicates with said gas-tight container and is filled with an absorbent for absorbing at least said carbon dioxide gas, wherein said gas-storage container absorbs said carbon dioxide gas to make inside of said gas-tight container in a state of reduced pressure.

2. The thermal insulator cabinet in accordance with claim 1, said thermal insulator cabinet further comprising a thermal system for carrying out a heat exchange with said gas-tight container and said gas storage container.

3. The thermal insulator cabinet in accordance with claim 1 or 2, wherein a mean gap distance of said continuous-spacing core is not greater than a mean free path of said charging gas at 20° C. and 1/100 atmospheric pressure.

4. The thermal insulator cabinet in accordance with claim 2, wherein said absorbent is a physical absorbent and said gas-storage container is constructed to carry out a heat exchange with a heat-absorbing portion of said thermal system.

5. The thermal insulator cabinet in accordance with claim 2, wherein said absorbent is a chemical absorbent and said gas-storage container is constructed to carry out a heat exchange with a heat-discharging portion of said thermal system.

6. The thermal insulator cabinet in accordance with claim 2, wherein said gas-storage container is disposed inside said thermal insulator cabinet, which is subjected to a heat exchange with said thermal system, said gas-storage container being subjected to an indirect heat exchange with said thermal system.

7. The thermal insulator cabinet in accordance with claim 2, wherein said thermal system is at least one of a cooling system with a compressor and a cooling system by a thermoelectric transducer.

8. A method of manufacturing a thermal insulator cabinet, said method comprising the steps of:

charging a continuous-spacing core into a gas-tight container with a carbon dioxide gas; and introducing said carbon dioxide gas into a gas-storage container, which is arranged to communicate with said gas-tight container, and causing said carbon dioxide gas to be absorbed by an absorbent in said gas-storage container, thereby making said gas-tight container in a state of reduced pressure.

9. The method in accordance with claim 8, wherein said thermal insulator cabinet comprises a thermal system for carrying out a heat exchange with said gas-tight container.

10. The method in accordance with claim 8, wherein said step of charging said continuous-spacing core comprises the steps of: injecting an urethane material that comprises at least a polyol, water, and an isocyanate into said gas-tight container; and charging a water-blown open-cell urethane resin into said gas-tight container with carbon dioxide produced through a reaction of said urethane material, and wherein said gas storage step comprising the step of causing carbon dioxide to be absorbed by said absorbent in said gas-storage container.

11. The method in accordance with claim 8, wherein said step of charging said continuous-spacing core comprises the step of enclosing a powdery material into said gas-tight container with said charging gas.

12. The thermal insulator cabinet in accordance with claim 2, wherein a mean gap distance of said continuous-spacing core is not greater than a mean free path of said charging gas at 20° C. and 1/100 atmospheric pressure.

13. The method in accordance with claim 9, wherein said step of charging said continuous-spacing core comprises the steps of: injecting a urethane material that comprises at least a polyol, water, and an isocyanate into said gas-tight container; and charging a water-blown open-cell urethane resin into said gas-tight container with carbon dioxide produced through a reaction of said urethane material, and wherein said gas storage step comprises the step of causing carbon dioxide to be absorbed by said absorbent in said gas-storage container.

14. The method in accordance with claim 9, wherein said step of charging said continuous-spacing core comprises the step of enclosing a powdery material into said gas-tight container with said carbon dioxide gas.

* * * * *